US009877522B1

(12) United States Patent
Martinson

(10) Patent No.: US 9,877,522 B1
(45) Date of Patent: Jan. 30, 2018

(54) SENSORY STIMULATING GARMENT

(71) Applicant: Christine Martinson, Richland, MI (US)

(72) Inventor: Christine Martinson, Richland, MI (US)

( * ) Notice: Subject to any disclaimer, the term of this patent is extended or adjusted under 35 U.S.C. 154(b) by 0 days.

(21) Appl. No.: 15/411,272

(22) Filed: Jan. 20, 2017

(51) Int. Cl.
*A41B 13/00* (2006.01)
*A41B 17/00* (2006.01)

(52) U.S. Cl.
CPC ..... *A41B 13/005* (2013.01); *A41B 17/005* (2013.01); *A41B 2300/322* (2013.01); *A41B 2400/80* (2013.01)

(58) Field of Classification Search
CPC ..... A41B 13/005; A41B 17/005; A41B 2300/322; A41B 2400/80
See application file for complete search history.

(56) References Cited

U.S. PATENT DOCUMENTS 2,663,873 A * 12/1953 Stern ..... A41B 13/005 2/79
4,843,648 A * 7/1989 Goldberg ..... A41B 13/005 2/80
4,985,968 A 1/1991 Hooper
5,005,218 A 4/1991 Ganz
5,058,208 A * 10/1991 Adams ..... A41B 13/005 2/227
5,153,940 A 10/1992 Bergquist
5,211,321 A 5/1993 Rodriguez
7,086,121 B2 8/2006 Lippincott
7,409,726 B2 8/2008 Bahm et al.
D643,181 S * 8/2011 Rickfors ..... D2/718
8,312,565 B1 11/2012 Alperin
2005/0050607 A1* 3/2005 Myers ..... A41D 13/1263 2/69
2009/0078596 A1 3/2009 Frump
2009/0222968 A1* 9/2009 Pisano-Ginter ..... A41B 13/005 2/80
2009/0293169 A1* 12/2009 Wise ..... A41B 13/005 2/80
2011/0231978 A1* 9/2011 Reid ..... A41B 13/06 2/80
2013/0012853 A1* 1/2013 Brown ..... A41D 13/0015 602/19
2013/0125286 A1 5/2013 Roberts
2013/0247277 A1* 9/2013 Turbovich ..... A41B 13/005 2/243.1

(Continued)

*Primary Examiner* — Khaled Annis
(74) *Attorney, Agent, or Firm* — Dale J. Ream

(57) ABSTRACT

A sensory stimulating garment for engaging the senses of an infant includes an upper body portion defining a head opening and a lower body portion having a pair of leg members. A zipper is in operative communication with the upper and lower body portions, the zipper having a slider engaged with a plurality of teeth and configured to open the garment from the leg opening to adjacent the head opening. A first sensory member is positioned on the upper body portion adjacent the head opening that includes a first tactile surface and a second tactile surface different than the first tactile surface. Additional sensory members may be positioned on the upper body portion—each having tactile characteristics different than any other sensory member so as to stimulate different tactile senses of an infant who may touch them while wearing the garment.

8 Claims, 8 Drawing Sheets

(56) References Cited

U.S. PATENT DOCUMENTS

| | | | | |
|---|---|---|---|---|
| 2013/0298304 | A1* | 11/2013 | Ott | A44B 19/24 2/80 |
| 2015/0059050 | A1* | 3/2015 | Cousin | A41B 13/08 2/80 |
| 2015/0224032 | A1 | 8/2015 | Dierker | |
| 2016/0278442 | A1* | 9/2016 | Moran | A41B 13/005 |
| 2016/0309805 | A1* | 10/2016 | Haller | A41D 11/00 |
| 2016/0317383 | A1* | 11/2016 | Stanfield | A61H 23/0236 |

* cited by examiner

SENSORY STIMULATING GARMENT

BACKGROUND OF THE INVENTION

This invention relates generally to apparel and, more particularly, to a garment for infants having a reverse zipper and a plurality of sensory members having tactile surfaces and sensory effects to entertain, educate, and soothe an infant while wearing the garment.

The first sense of a baby is to touch—even while inside the womb. A developing baby may experience touch at only 8 weeks in utero. His first sensation is around the lips and cheeks. By 11 weeks he explores his warm, dark environment with his mouth, feet, and hands. Ultrasounds have revealed the fetus holding onto the umbilical cord and rolling around inside the amniotic sac. This fluid-filled environment is where the fetus first uses touch to both soothe and teach himself. A neonate (i.e. a newborn up to 4 weeks old), during his first month outside of the womb, experiences many positive and negative sensations.

"Preemies" (babies born before 37 weeks) and full term infants alike will try to bring their hands together, such as to their face, or lay them on their heads and ears which may result in scratches to those sensitive areas. There is a need to stimulate the infant so as to avoid these negative results and to soothe the infant with positive tactile sensory stimulation. It is understood that elderly persons or people with Alzheimer's disease are also likely to benefit from the soothing effects of sensory stimulation integrated into a garment.

Therefore, it would be desirable to have a sensory garment that includes tactile sensory objects woven or coupled into the fabric of the garment so as to be readily available to be touched or manipulated by the wearer of the garment. Further, it would be desirable to have a sensory garment having integrated sensory members that provide many different tactile and audible stimuli arranged in spaced apart positions on the exterior surface of the garment. In addition, it would also be desirable to have a sensory stimulation garment that may be opened by a zipper that is operated from the bottom toward the top.

SUMMARY OF THE INVENTION

A sensory stimulating garment for engaging and comforting the senses of an infant according to the present invention includes an upper body portion configured for wear on an upper torso of the infant, the upper body portion defining a head opening and having a pair of arm members extending away from the head opening. A lower body portion is configured for wear on a lower body of the infant having a waist, a pair of leg members extending away from the waist, and a crotch at an upper juncture of the pair of leg members. A zipper is in operative communication with the upper and lower body portions, the zipper having a slider engaged with a plurality of teeth, the slider being selectively movable between a fully closed configuration adjacent a foot opening of a respective leg member and a fully opened configuration adjacent the head opening. The zipper extends along one of the pair of leg members, across the crotch, and along the upper body portion to a point adjacent the head opening.

A first sensory member is positioned on the upper body portion adjacent the head opening that includes a first tactile surface and a second tactile surface different than the first tactile surface. Additional sensory members may be positioned on the upper body portion—each having tactile characteristics different than any other sensory member so as to stimulate different tactile senses of an infant who may touch them while wearing the garment.

Therefore, a general object of this invention is to provide a sensory stimulating garment for engaging and comforting the senses of an infant.

Another object of this invention is to provide a sensory stimulating garment, as aforesaid, that includes an integrated upper and lower body portion in the form of an infant sleeper having multiple sensory members on respective frontal surfaces with which the infant may touch, feel, and hear.

Still another object of this invention is to provide a sensory stimulating garment, as aforesaid, in which respective sensory members include different tactile surfaces that the infant may grip, crinkle, and manipulate.

A further object of this invention is to provide a sensory stimulating garment, as aforesaid, having a zipper that extends from a foot opening to adjacent a head and neck opening, the zipper opening the garment initially from the foot opening upwardly.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
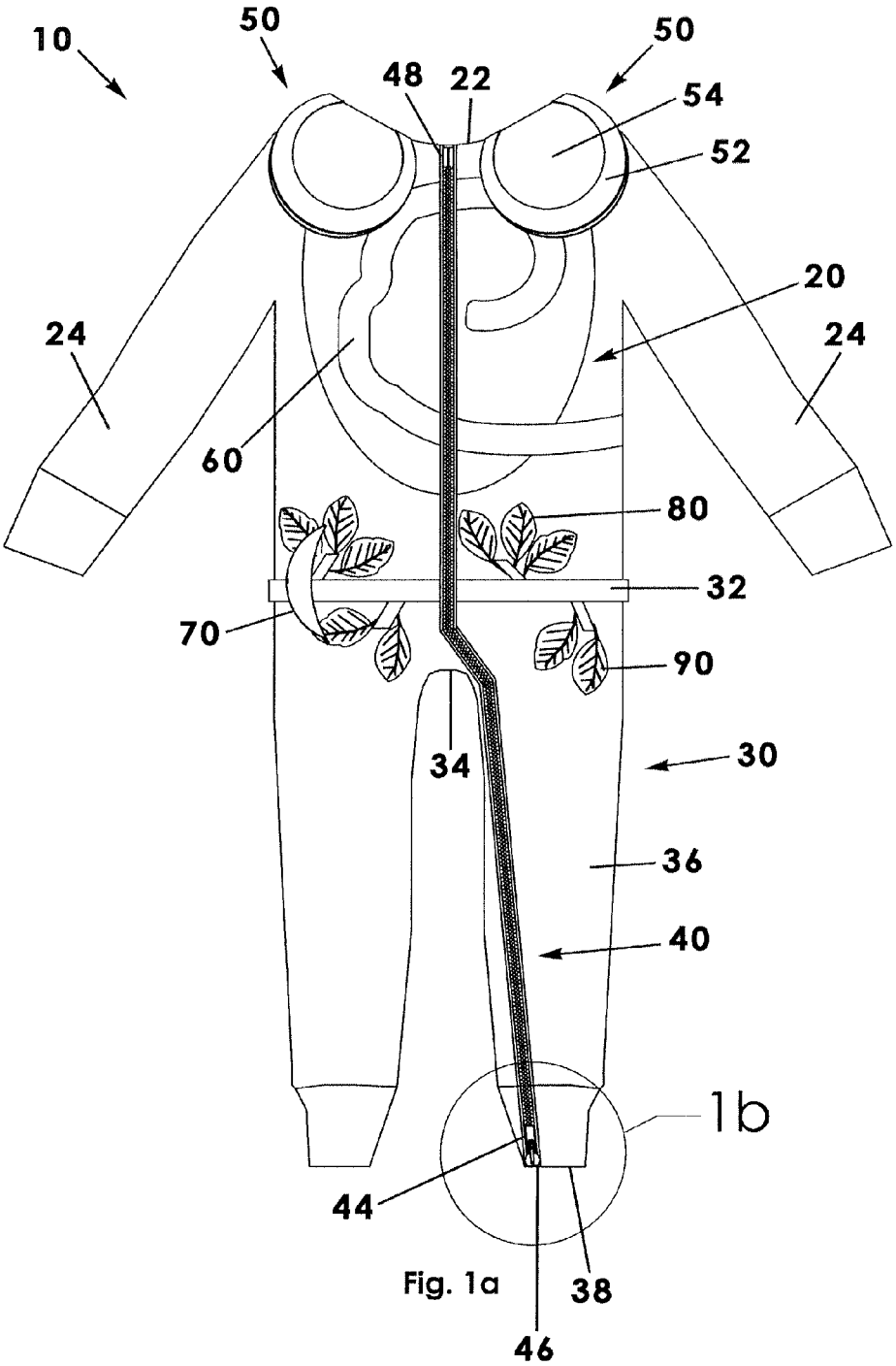
FIG. 1*a* is a front view of a sensory stimulating garment according to a preferred embodiment of the present invention.
Figure 1B:
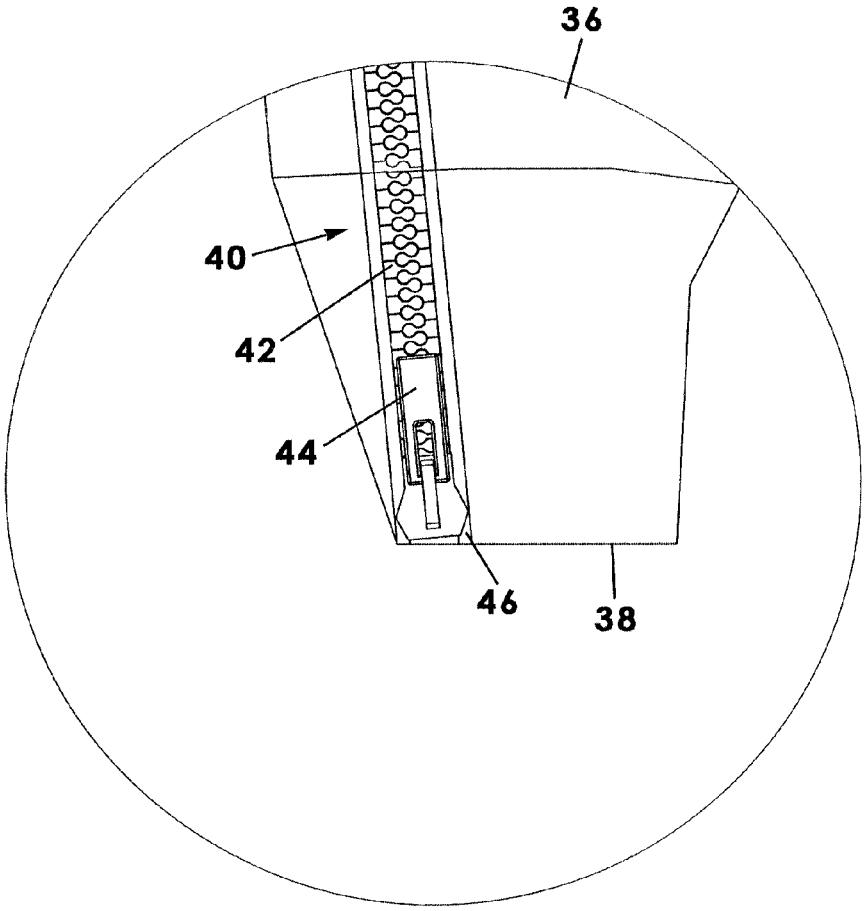
FIG. 1*b* is an isolated view on an enlarged scale taken from FIG. 1*a;*

A sensory stimulating garment according to a preferred embodiment of the present invention will now be described in detail with reference to FIGS. 1*a* to 5*b* of the accompanying drawings. The sensory stimulating garment 10 includes an upper body portion 20, a lower body portion 30, a zipper 40, and multiple spaced apart sensory members.

The sensory stimulating garment 10 includes an upper body portion 20 configured to be worn on an upper torso of an infant. Preferably, the basic configuration of the upper body portion 20 is in the form of traditional pajamas, namely, including a body covering shirt section defining a head opening 22 and having a pair of arm portions 24 extending away from the head opening 22.

The sensory stimulating garment 10 includes a lower body portion 30 configured to be worn on a lower torso of an infant. Again, the basic configuration of the lower body portion 30 is in the form of traditional pajamas, namely, including a waist 32 or waistband, a pair of leg members 36 extending downwardly away from the waist 32, and having a crotch 34 at an upper juncture of the leg members 36. In an embodiment, the upper body portion 20 and lower body portion 30 include a unitary one-piece construction and are configured in the form of a one-piece infant "sleeper" such that an entirety of the garment 10 may be selectively opened and closed via an elongate zipper 40, as will be described below.

Figure 1C:
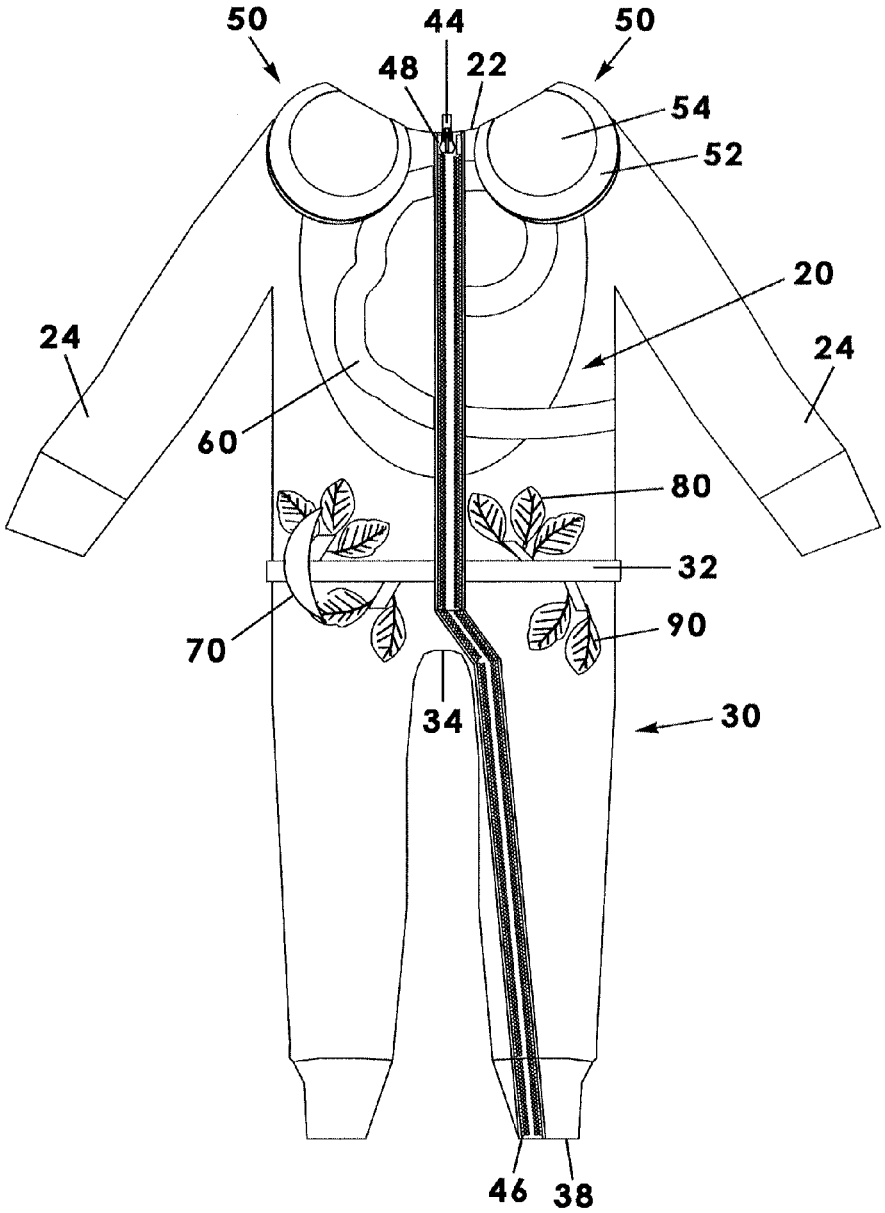
FIG. 1*c* is a perspective view of the sensory stimulating garment as in FIG. 1*a*, illustrating a zipper in a full open configuration.
Figure 1D:
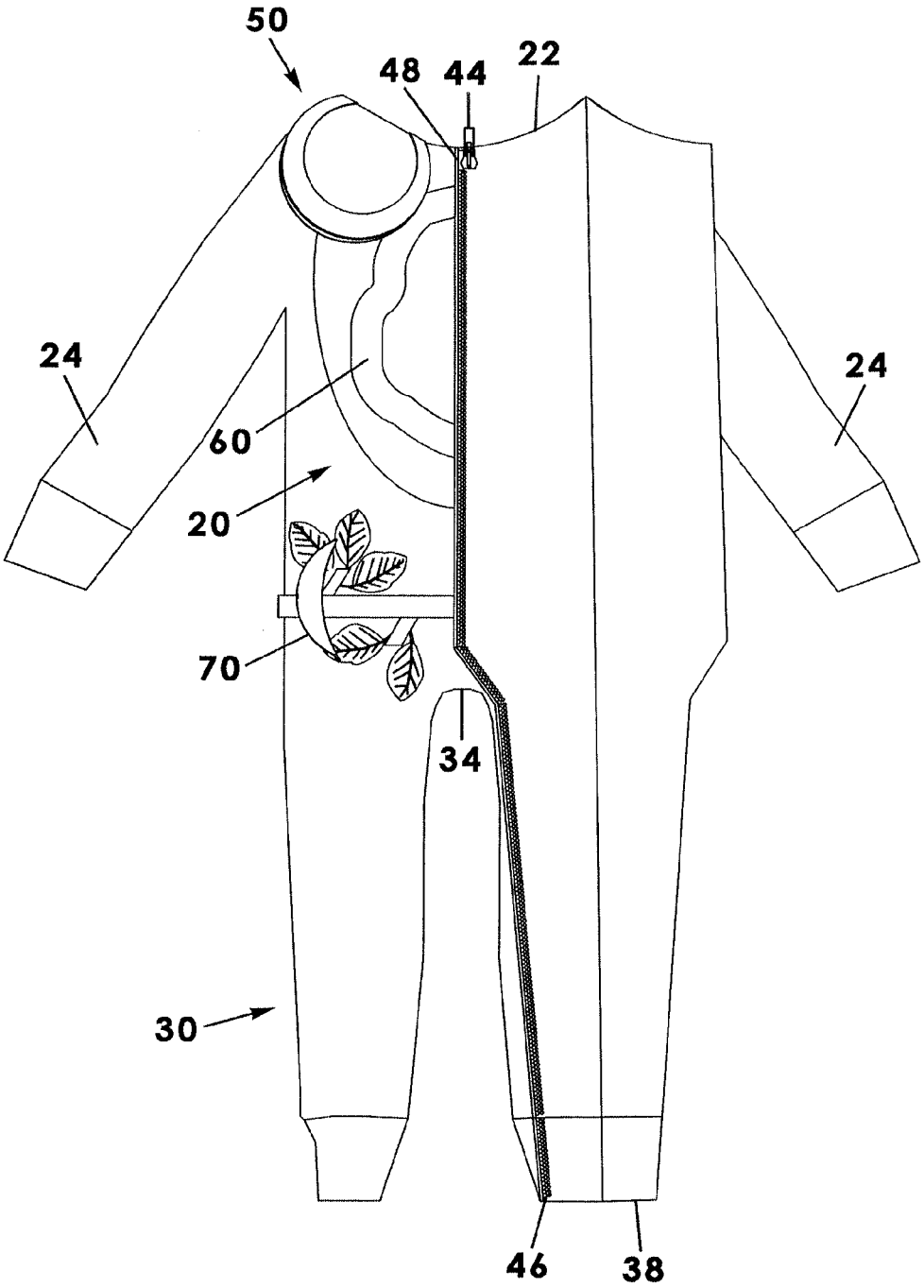
FIG. 1*d* is another perspective view of the sensory stimulating garment as in FIG. 1*a*, illustrating the zipper in a full open configuration and the garment in a full open configuration.
Figure 2:
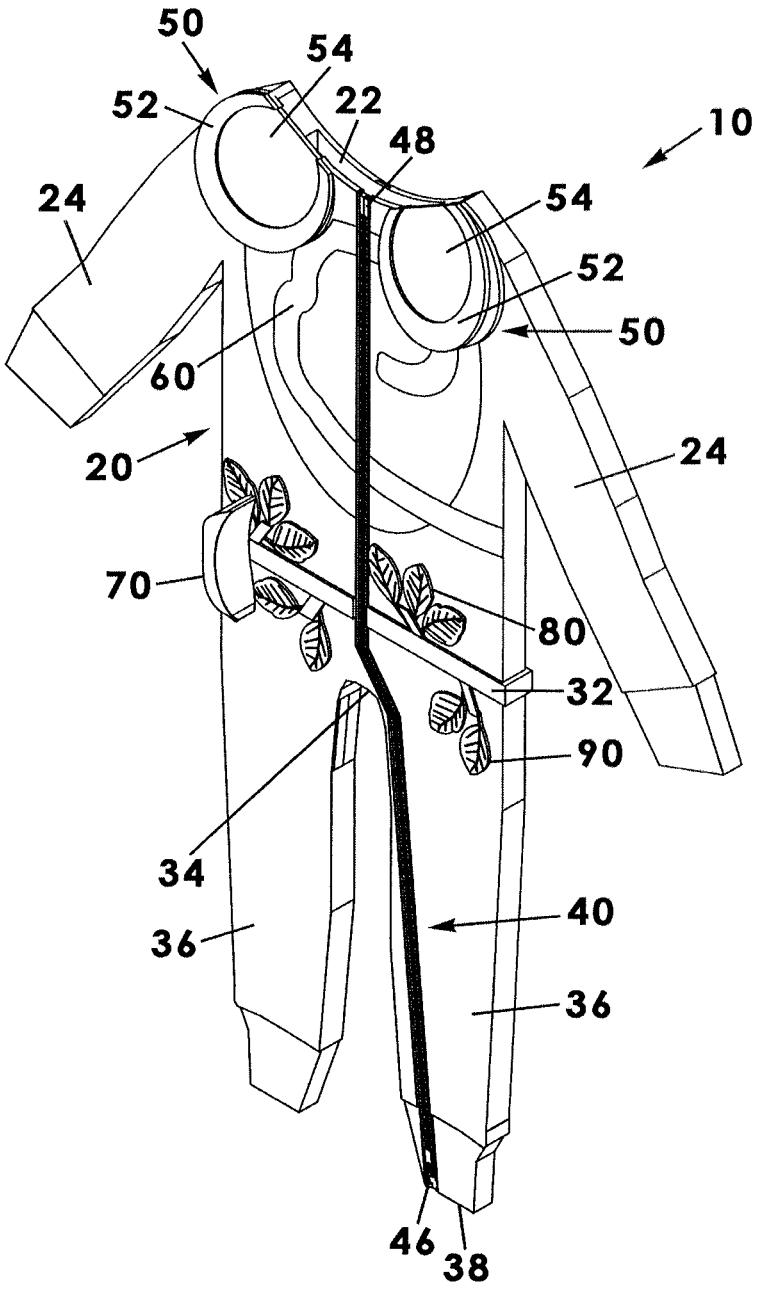
FIG. 2 is a perspective view of the sensory stimulating garment as in FIG. 1*a;*

The zipper 40 may be integrally constructed to extend substantially from bottom to the top of the garment 10. The zipper 40 is in operative communication with both the upper body portion 20 and the lower body portion 30. The zipper 40 may include a plurality of teeth 42 and a slider 44 configured to selectively engage the teeth and move therealong. The zipper 40 has a proximal end 46 or starting point at foot opening 38 of one of the pair of leg members 36 of the lower body portion 30 of the garment 10. The zipper 40 has an elongate configuration that then extends from the foot opening 38 upwardly along the leg member 36, through the crotch 34, and upwardly across the upper body portion 20 to a distal end or terminal point adjacent the head opening 22. The garment 10 is at a fully closed configuration when the slider 44 is at the proximal end 46 (FIG. 1) and is at a fully opened configuration when the slider 44 is at the distal end 48 (FIGS. 1*c* and 1*d*). It is understood that by opening first from the foot opening 38 and then upwardly, the crotch of the garment 10 may be opened to access the infant's diaper without having to extricate the infant's arms and torso from the upper body portion 20 as is traditional and disadvantageous with traditional infant sleeper garments.

The sensory stimulating garment 10 may include multiple sensory members—each having unique tactile and other sensory characteristics that may be experienced by an infant wearing the garment. In addition, the sensory members may also have respective shape configurations indicative of parts of an animal, cartoon character, inanimate object, or the like. For example, respective sensory members may resemble the ears or tail of an animal. More particularly, a first sensory member 50 may be coupled to an exterior surface of the upper body portion 20. Preferably, the first sensory member 50 may be positioned adjacent one or both shoulder areas of the upper body portion 20 and may include a first tactile surface 52 and a second tactile surface 54 that is different than the first tactile surface 52. In other words, the second tactile surface 54 provides a different sensory perception when touched by the infant or by any person in proximity to it.

In an embodiment, the first tactile surface 52 of the first sensory member 50 may be constructed of a high friction gripping material. For instance, the first tactile surface 52 may be made of silicone gel, foam rubber, ethylene propylene rubber, or other materials having similar frictional characteristics. In use, the infant may find it desirable to repeatedly grip this material. By contrast, the second tactile surface 54 of the first sensory member 50 may be constructed of a low friction and very smooth material. For instance, the second tactile surface 54 of the first sensory member 50 may be constructed of silk or suitable equivalents such as satin, rayon, charmeuse, chiffon, crepe, or other materials having similar tactile characteristics. In use, the infant may find it desirable to contrast the gripping material with the smooth material. Preferably, the second tactile surface 54 is positioned concentrically relative to the position of the first tactile surface 52 or is otherwise positioned in close proximity or overlapping adjacent proximity therewith so that an infant may contrast the sensory perceptions of the two surfaces.

In an embodiment, the sensory stimulating garment 10 may include a second sensory member 60 positioned on and coupled to the exterior surface of the upper body portion 20, the second sensory member 60 being displaced from the placement of the first sensory member 50. The second sensory member 60 may include a tactile surface (which may also be referred to herein as a "second tactile surface") that has a sensory characteristic that is different from one or both tactile surfaces of the first sensory member 50. In addition, the second sensory member 60 may include more than one tactile surface having contrasting sensory characteristics in the manner described previously relative to a preferred embodiment of the first sensory member 50. Preferably, the second sensory member 60 may include fur and a shape configuration indicative of the tail of an animal. The furry material may be faux fur applied to a fabric, genuine animal fur, a fabric having the texture indicative of fur, or other suitable material having characteristics or fibrous weave of fur.

Similarly, the sensory stimulating garment 10 may include a third sensory member 70 positioned on one of the upper body portion 20 or lower body portion 30 or overlapping both. Again, the third sensory member 70 may include one or more tactile surfaces different than respective tactile surfaces of the sensory members described above. The third sensory member 70 may be raised above or extend outwardly from the exterior surface of the respective body portion. In general, the tactile characteristic of the third sensory member 70 is attributed to a construction of resilient material. In other words, the material is configured to be compressed (FIG. 5*b*) and resilient to return to its original expanded size (FIG. 4*b*) after being squeezed, poked, pinched, or the like. More particularly, the third sensory member 70 may have an internal portion 72 that includes a sponge or be constructed of a spongy cellular material, sponge foam, a cushion, an elastic material, a spring, or other similar material that resumes its shape after being squeezed or manipulated.

Still further, the sensory stimulating garment 10 may include a fourth sensory member 80 having a tactile surface that, when manipulated, provides an audible stimulus. More particularly, the tactile surface of the fourth sensory member 80 is constructed of a noise-making material such as cellophane plastic, paper, organic chips (e.g. potato chips), loop tricot material, bells, metal fragments, or other material suitable for causing a "crinkly" sound when crumpled, squeezed, rubbed together, or the like. In an embodiment, the fourth sensory member 80 may be embodied as "leaves" on a surface of one of the upper or lower body portions.

In another embodiment, other indicia 90 in the form of imprinted images may be imprinted or applied to a surface of the sensory stimulating garment 10. For instance, color indicia indicative of leaves, a forest, an animal habitat, or the like may be imprinted on the garment 10 to give context to the sensory members.

Figure 3:
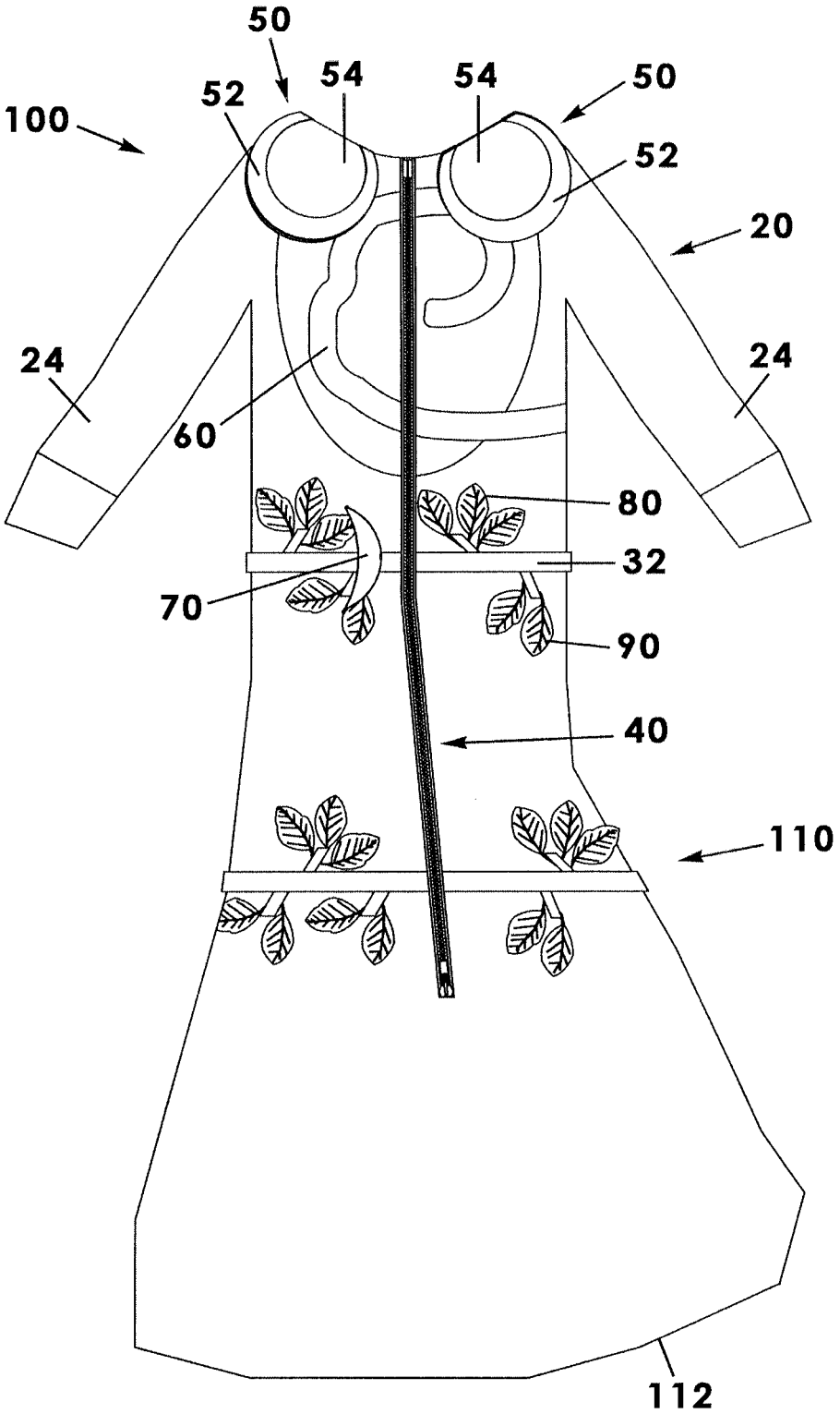
FIG. 3 is a sensory stimulating garment according to another embodiment of the present invention.
Figure 4A:
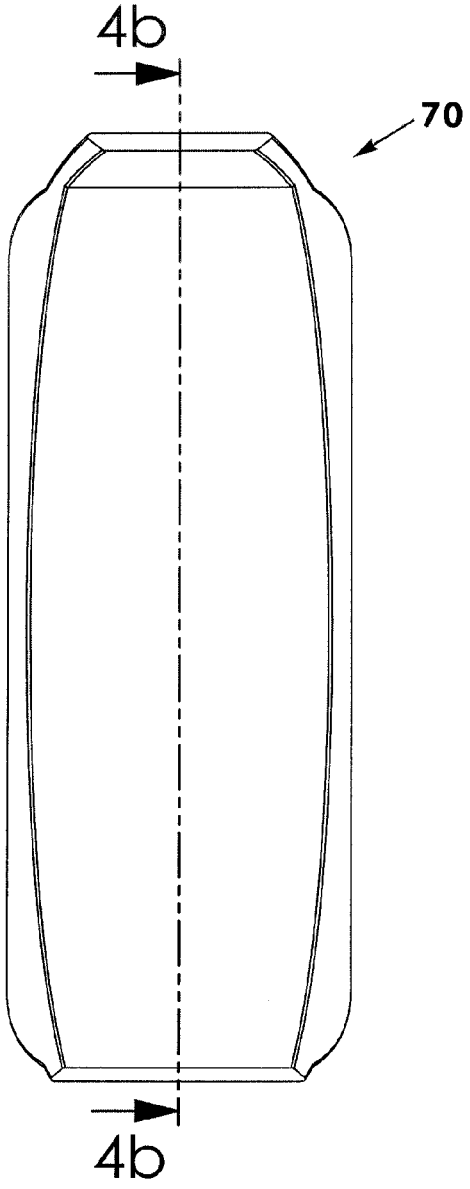
FIG. 4*a* is a front view of a sensory member of the present invention.
Figure 4B:
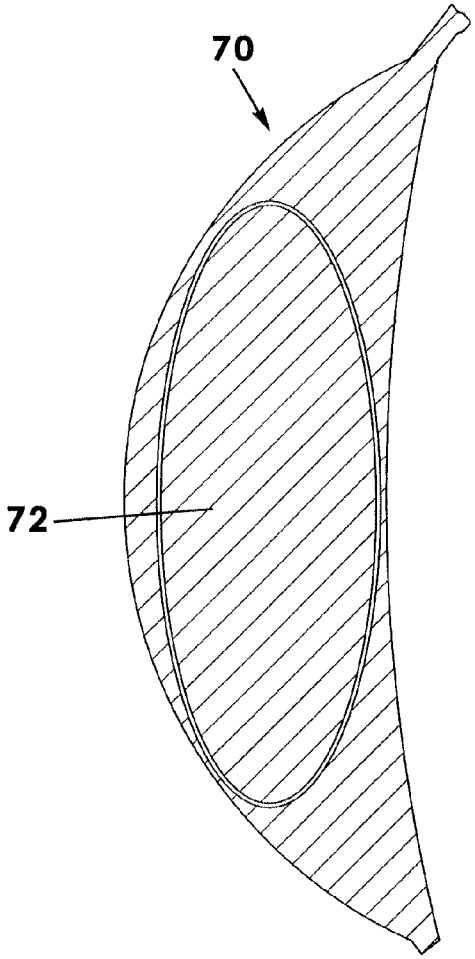
FIG. 4*b* is a sectional view taken along line 4*b*-4*b* of FIG. 4*a*, illustrating an internal portion in a resilient or expanded configuration.
Figure 5A:
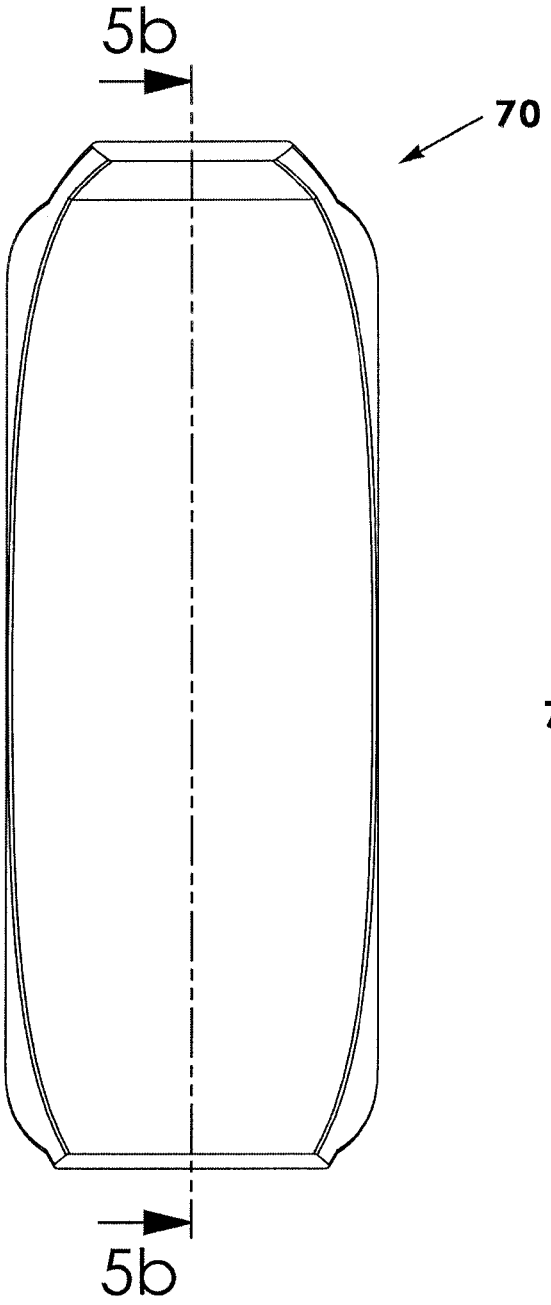
FIG. 5*a* is a front view of a sensory member of the present invention.
Figure 5B:
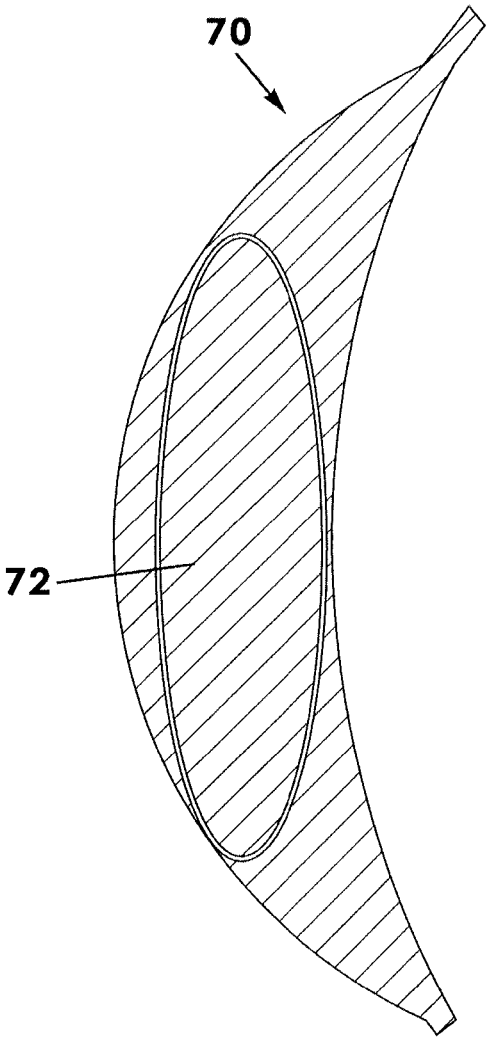
FIG. 5*b* is a sectional view taken along line 5*b*-5*b* of FIG. 5*a*, illustrating an internal portion in a compressed configuration.

In an embodiment, the sensory stimulating garment may be in the form of a night gown or blanket as indicated by reference numeral 100 (FIG. 3). The lower portion 110 may include an open bottom 112 as opposed to having leg members as described previously. Otherwise, the sensory stimulating garment 100 may include the sensory members described previously.

In use, an infant child may be dressed in the sensory stimulating garment 10. Whether at a time of initial dressing or anytime the infant's diaper needs to be accessed, e.g. a diaper change, an opening operation of the zipper 40 may be initiated by a user, e.g. a parent or guardian. As described above, the zipper 40 is opened beginning at the foot opening 38 of a respective leg member 36 and incrementally operated to open the leg and crotch 34. While being worn, the sensory members are available to be manipulated by the fingers of the infant, whether for gripping, petting, touching, crinkling, or the like. In this manner, an infant is afforded the opportunity to increase his awareness of his environment and to receive comfort and assurance as a result.

It is understood that while certain forms of this invention have been illustrated and described, it is not limited thereto except insofar as such limitations are included in the following claims and allowable functional equivalents thereof.

The invention claimed is:

1. A sensory stimulating garment for engaging and comforting the senses of an infant, comprising:

an upper body portion defining a head opening and having a pair of arm members extending away from said head opening such that said upper body portion is configured for wear on an upper torso of the infant;

a lower body portion having a waist, a pair of leg members extending away from said waist, and a crotch at an upper juncture of said pair of leg members such that said lower body portion is configured for wear on a lower body of the infant;

a zipper integrally constructed and in operative communication with said upper and lower body portions, said zipper having a slider engaged with a plurality of teeth, said slider being selectively movable between a fully closed configuration at which said slider intersects with a foot opening of a respective leg member and a fully opened configuration at which said slider intersects with said head opening;

wherein said zipper extends along one of said pair of leg members, across said crotch, and along said upper body portion to a point that joins with said head opening;

wherein said zipper is opened by moving said slider from said fully closed configuration adjacent a foot opening of a respective leg member to said fully opened configuration adjacent said head opening;

a first sensory member positioned on said upper body portion adjacent said head opening that includes a first tactile surface having a high friction gripping material positioned on one side of said head opening and that includes a second tactile surface having a smooth material positioned on another side of said head opening in communication with and having a different tactile sensation from said first tactile surface;

a second sensory member positioned on said upper body portion and displaced from said first sensory member, said second sensory member includes fur having a tactile surface different from said first and second tactile surfaces of said first sensory member;

a third sensory member includes a back side coupled to one of said upper body portion and said lower body portion and having at least three sides free of said one of said upper body portion and said lower body portion so as to be squeezed by the infant, said third sensory member having a tactile surface different than said first tactile surface of said first sensory member and constructed of a resilient material that returns to an original state after being depressed by a user;

wherein said resilient material of said third sensory member is taken from a group consisting of a sponge, spongy cellular material, sponge foam, elastic material, a cushion, and a spring;

a fourth sensory member displaced from said first, second, and third sensory members and having a tactile surface configured to emit an audible stimulus when manipulated by a user.

2. The sensory stimulating garment as in claim 1, wherein said upper and lower body portions have a unitary construction.

3. The sensory stimulating garment as in claim 1, wherein said upper and lower body portions, together, comprise an infant one-piece sleepwear.

4. The sensory stimulating garment as in claim 1, wherein:

said high friction gripping material of said first tactile surface of said first sensory member is taken from a group consisting of silicone gel, foam rubber, and ethylene propylene rubber;

said smooth material of said second tactile surface of said first sensory member is taken from a group consisting of silk, satin, rayon, charmeuse, chiffon, and crepe; and said first tactile surface has a different tactile sensory perception than that of said second tactile surface when touched by a person.

5. The sensory stimulating garment as in claim 1, wherein said fur of said second sensory member is taken from a group consisting of faux fur fabric, genuine animal fur, and fabric having a fur texture, such that said tactile surface of said second sensory member is indicative of an animal tail.

6. The sensory stimulating garment as in claim 1, wherein said third sensory member extends away from an exterior surface of one of said upper body portion and said lower body portion.

7. The sensory stimulating garment as in claim 1, wherein said fourth sensory member includes noise-making material taken from a group consisting of cellophane plastic, paper, organic chips, loop tricot material, bells, and metal fragments.

8. The sensory stimulating garment as in claim 1, further comprising printed indicia on an exterior surface of one of said upper body portion or said lower body portion.

* * * * *